US007096527B2

(12) United States Patent
Malik

(10) Patent No.: US 7,096,527 B2
(45) Date of Patent: Aug. 29, 2006

(54) BEDSPREAD HOLDER

(75) Inventor: James J. Malik, Parma Heights, OH (US)

(73) Assignee: Eagle Wire Works, Cleveland, OH (US)

( * ) Notice: Subject to any disclaimer, the term of this patent is extended or adjusted under 35 U.S.C. 154(b) by 0 days.

(21) Appl. No.: 11/246,612

(22) Filed: Oct. 7, 2005

(65) Prior Publication Data

US 2006/0075557 A1 Apr. 13, 2006

Related U.S. Application Data

(60) Provisional application No. 60/616,906, filed on Oct. 8, 2004.

(51) Int. Cl.
*A47C 21/02* (2006.01)

(52) U.S. Cl. ..... 5/504.1

(58) Field of Classification Search ..... 5/504.1, 5/505.1, 506.1
See application file for complete search history.

(56) References Cited

U.S. PATENT DOCUMENTS

| | | | |
|---|---|---|---|
| 2,979,736 | A | 4/1961 | Kemman |
| 3,435,469 | A | 4/1969 | Fricke |
| 5,305,480 | A | 4/1994 | Loren et al. |
| 5,652,979 | A | 8/1997 | Pugh et al. |

*Primary Examiner*—Alexander Grosz
(74) *Attorney, Agent, or Firm*—Tarolli, Sundheim, Covell & Tummino LLP

(57) ABSTRACT

A bedspread holder utilizing a series of U-shaped members to support a bedspread off of the ends of a bed with an actuation handle connected to a support leg. The support leg can be rotated from a storage position substantially in the same plane as the U-shaped support member to a use position substantially perpendicular to such support member plane.

18 Claims, 3 Drawing Sheets

BEDSPREAD HOLDER

Related Application

This application corresponds to and claims priority from U.S. Provisional Patent Application Ser. No. 60/616,906, filed Oct. 8, 2004, the subject matter of which is incorporated by reference.

This invention relates to a bedspread holder, which holder has a storage support member extending between the mattress and box spring together with an articulated support leg, which support leg has an integral handle so as to allow the bedspread holder to be moved between a support and a storage position.

BACKGROUND OF THE INVENTION

This invention relates to a bedspread holder.

Over the years there have been numerous attempts to design and build a bedspread holder which is both easy to use as well as efficient. Examples include U.S. Pat. No. 2,979,736 entitled Spread Holder, U.S. Pat. No. 3,435,469 entitled Collapsible Bedspread-Holder, U.S. Pat. No. 5,305,480 entitled Bedspread Saver, and U.S. Pat. No. 5,652,979 entitled Holder for Bed Covers. Typically, these bedspread holders are difficult to operate (U.S. Pat. No. 2,979,736) or have relatively complex or difficult to operate legs (U.S. Pat. No. 3,435,469 or U.S. Pat. No. 5,305,480).

Further to the above, a bedspread holder should be simple, easy to store, as well as low cost. The bedspread holder of the present invention fulfills these needs.

SUMMARY OF THE INVENTION

A bedspread holder is comprised having generally U-shaped support storage members as well as a support leg. In this holder, the support leg rotates 90° in respect to the main elements to facilitate movement of the holder from a storage position entirely underneath the mattress to one that is mostly spaced of such mattress with the support leg supporting the outer ends of the holder.

OBJECTS OF THE INVENTION

It is an object of this invention to facilitate the storage of a bedspread;

It is an additional object of this invention to simplify the storage of a bedspread;

It is another object of this invention to reduce the cost of storing a bedspread;

It is a further object of this invention to facilitate the use of a bedspread on a mattress;

It is an yet a further object of this invention to facilitate the usability of a bedspread holder;

Other objects of the invention and a more complete understanding of the invention may be had referring to the drawings within this application in which:

DETAILED DESCRIPTION OF THE INVENTION

Figure 1:
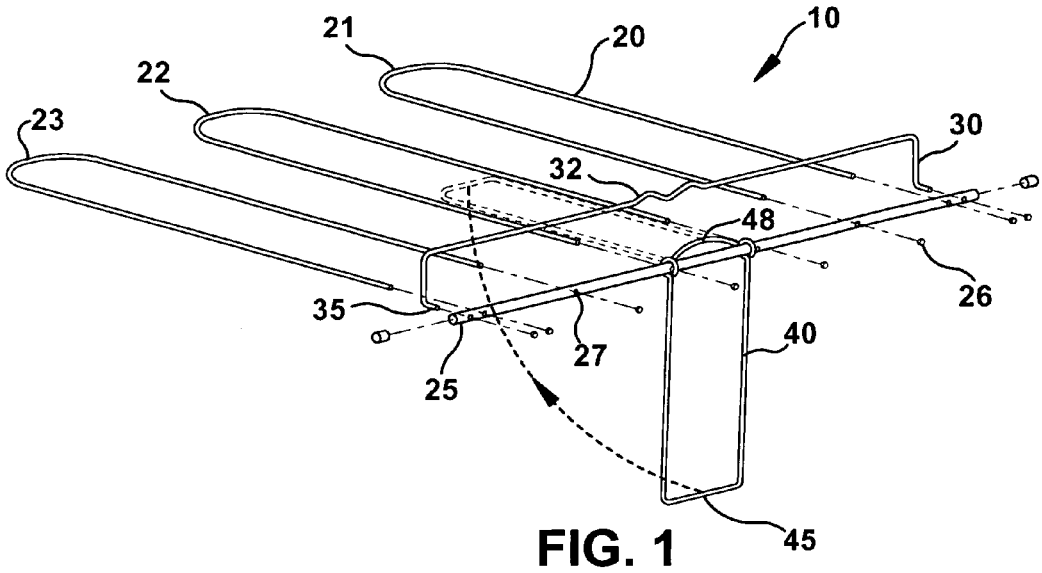
FIG. 1 is a perspective view of the preferred embodiment of the present invention.

This invention relates to a bedspread holder for storing bedspreads, comforters, pillows, and other secondary coverings and items (hereinafter referred to as bedspreads) used with beds.

The bedspread holder 10 has an extender member 20, a retaining member 30, and a support member 40.

The extender member 20 serves to physically support the bedspread 100 when in an open position and serves to physically guide the bedspread holder 10 between use and storage positions during the transition therebetween.

In a use position, the bedspread extender member 20 defines a planar support for the bedspread 100 and for storage. In the preferred extender member 20 disclosed, there are three generally U-shaped rods 21, 22, 23 extending from a laterally extending main connection tube 25. These rods 21, 22, 23 interconnect to the connection tube 25 through a series of hex nuts 26 located in dimpled holes 27 of the connection tube 25 (acorn nuts shown). This use of hex nuts 26 provides for a secure interconnection between the extender member 20 and the connection tube 25, while at the same time allowing for a flexibility of rod inclusion and location over a series of bedspread holders 10. For example, by adding to or subtracting from the number of rods used for a specific holder 10 and/or varying spacing between rods with corresponding main tube length variation, a range of sizes can be provided from single to California king. The use of hex nuts 26 also allows for any given holder 10 to be shipped or stored in an unassembled condition, thus lowering the cost and expense of both. Further, the cooperation with the dimples acts as a locknut. The ends of the acorn nuts in the preferred embodiment smooth the ends of the rods 21–23.

Figure 3:
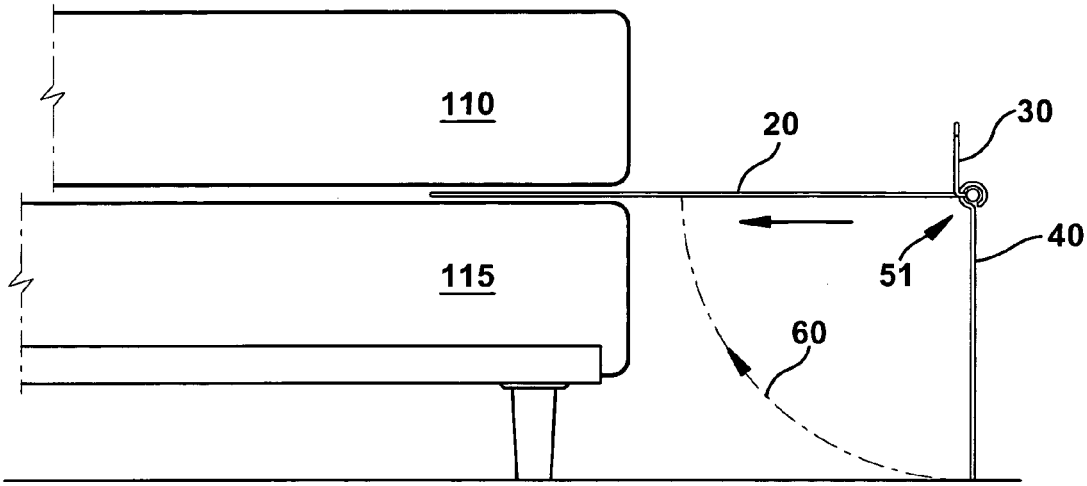
FIG. 3 is a view like FIG. 2 emphasizing the transition movements between the support leg support position and the holder storage position.

The rods 21, 22, 23 are designed to fit between a mattress 110 and a bed support part 115 (a box spring is shown in the preferred embodiment). By a movement along a longitudinal axis of the rods 21, 22, 23, the entire holder 10 can be moved between an inner storage position 50 and an outer use position 51. This movement occurs along a longitudinal axis of the extender member 20 (contrast figs 3 and 4).

Figure 4:
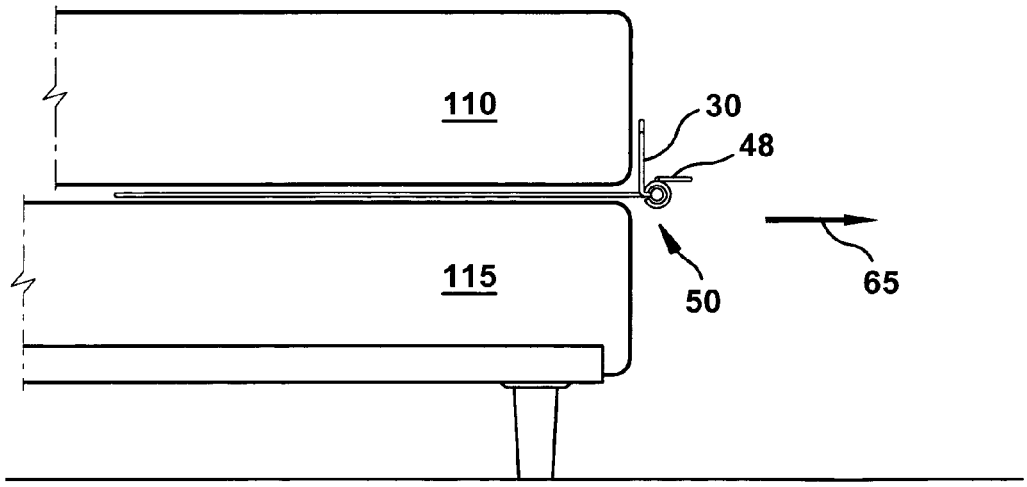
FIG. 4 is a view like FIG. 2 of the holder in a storage position.
Figure 5:
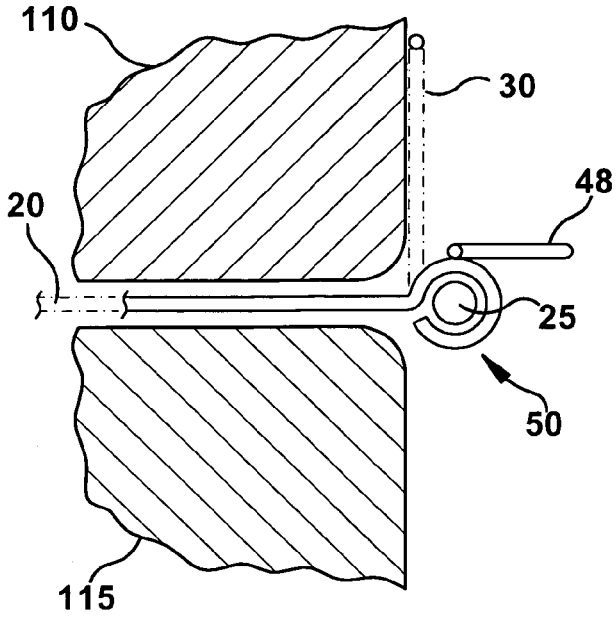
FIG. 5 is an enlarged sectional view of the top of the support leg in the storage position of FIG. 4.
Figure 6:
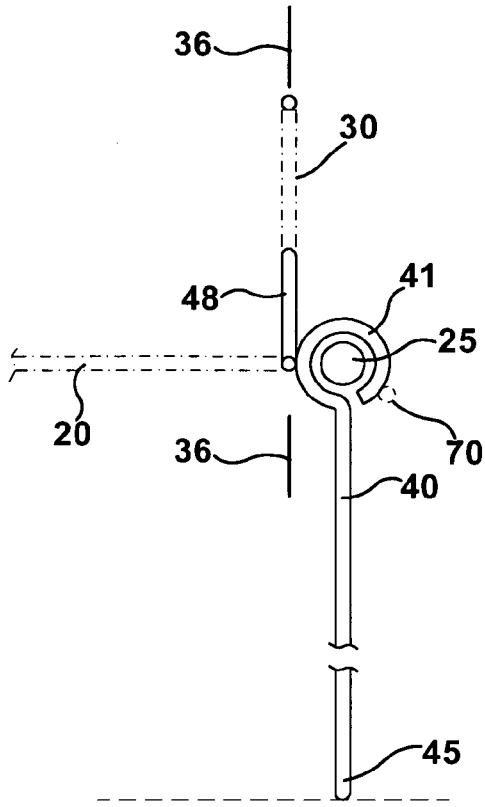
FIG. 6 is an enlarged sectional view of the top of the support leg in the use position of FIG. 3; and, FIG. 7 is a view of the holder's major components.
Figure 7:
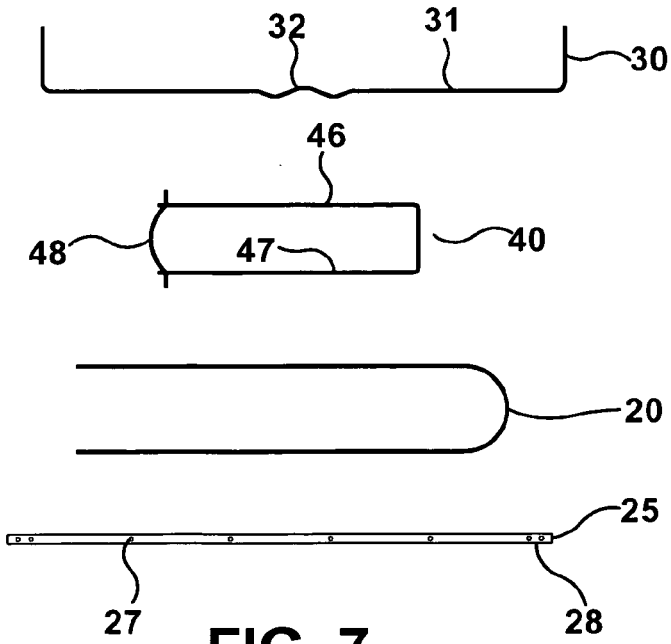

The retaining member 30 serves a triple purpose of providing for: a convenient stop at the inner storage position 50 of the bedspread holder 10 (FIG. 4); an outer side of the holder 10 in the outer use position 52 of the holder (FIG. 2); as well as, a locator for manipulation of the support leg 40 during transitions (FIGS. 5, 6).

The particular retaining rod member 30 shown is a rod 31 having a central locator section 32 and an outer end/alignment edge 35 (fig 1).

The rod itself provides an edge plane of retention substantially perpendicular to the plane of the extender member 20 at the outer end of the holder 10. This serves as a convenient end to the holder 10 when the device is being utilized in its use position (FIG. 2) as well as providing a convenient stop when the device is being utilized in its storage position (FIG. 4). The retaining rod member 30 further aligns the holder 10 in respect to the mattress 110.

The central locator section 32 is a deflection of the rod 31 from its normal straight section in order to provide for an easily discernible central locating indicator, as well as strengthening of the rod 31 (W deflection shown). In the single support leg embodiment disclosed, the central locator section 32 also gives notice to the consumer that the retaining rod member 30 is not the preferred handle to move the holder 10 between its inner storage position (FIGS. 4, 5) and outer use position (FIGS. 2, 6): the handle 48 on the support leg 40 is.

An alignment edge 35 serves to orient the retaining rod member 30 in a plane 36 slightly divergent from that extending straight off of the main tube 25 perpendicular to the extender member 20. This allows access to the holder 10 even while it is being stored (see FIG. 5). It also serves to allow for the use of a series of additional holes 28 in the main tube 25 parallel to, but spaced from, the extender member 20 to serve as the interconnection between the retaining member 30 and the main tube 25. In that these holes 28 can be created in the same operation as the dimples 27, a single manufacturing station is thus necessary to manufacture the connection tube 25.

The support leg 40 provides a retractable handle 48 for the holder 10 while also serves to physically support the outer end of the bedspread holder 10 when such holder 10 is in its outer use position 51.

Figure 2:
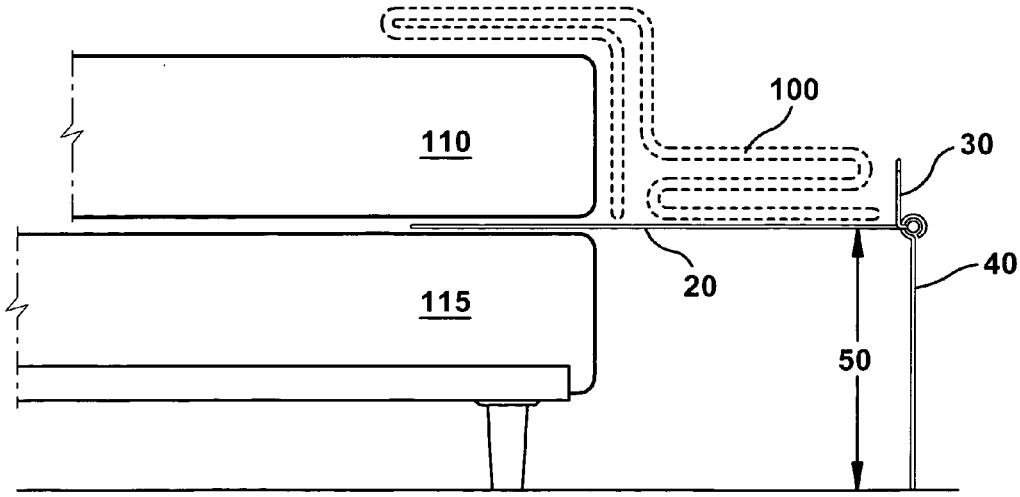
FIG. 2 is a side view of the bedspread holder in a typical use position.

The particular support leg 40 shown has a self-formed circular end 41 to interconnect the upper end of the support leg 40 to the connection tube 25. This connects the support leg 40 to the rest of the holder 10 while also providing an axis for rotation (as later described). The support leg 40 in addition has a lower end 45 interconnecting two adjacent sides 46, 47. The width of this lower end 45 provides an additional support for the bedspread holder 10 against a rocking motion. It, in addition, insures that a single movement of the support leg 40 will move the entire support leg between a storage and a use position. The height 50 of the support leg 40 is designed to hold the bedspread extender member 20 substantially parallel to the axis of separation between the mattress 110 and the bed support part 115 (FIG. 2). As the height of the bed support part 115 from the floor (whether a box spring, board, or otherwise) is generally universally within a certain limited range irrespective of the mattress 110, a single bedspread holder 10 can be utilized with a multiplicity of mattresses (such as a pillow top, a regular mattress, or a futon).

In the present invention of the application, an actuation/storage handle 48 is interconnected to the top of the support leg 40.

The actuation handle 48 itself is used to move the holder 10 between its use and storage positions and to pivot the support leg 40 from its use position (FIG. 2) to its storage position (FIG. 4). As the handle 48 is exposed from the remainder of the holder 10, it is easily accessible for occasioning this movement (see FIG. 5).

To move to a use position (FIG. 2), the user grasps the handle 48 and pulls the holder 10 in a plane 65 co-extensive with the extender member 20. This moves the holder 10 outwards. When a sufficient longitudinal movement has been accomplished such that the lower end 45 is free from the bed, the support leg 40 can be operative. As soon as this end 45 of the leg 40 is freed from the bed support part 115, the user will feel a rotary force on the handle 48. This signifies that the support leg 40 could be dropped to its use position by releasing the handle at any time the user desires (up to the length of the rods 21, 22, 23 that form the extender member 20 in the preferred embodiment disclosed). On dropping the support leg 40, it rotates into its use position (due to the weight of the leg itself in the embodiment disclosed). The holder 10 can then be used (FIG. 2). Note that the gravity operation of the support leg is preferred for its inherent simplicity. If desired, a spring could be incorporated to facilitate the movement.

To move the holder to storage position, the user reaches within the retaining member 30 to grasp the handle 48 (FIG. 6). The locator 32 on the retaining member 30 easily provides the location for the handle 48 of such-support leg. Further in the embodiment disclosed, the locator 32 also reduces the apparent height of the retaining member 30 at this location. This, in combination with the edge 35, locates such handle 48 within grasping distance and in planar alignment (plane 36) of the retaining rod. A slight upwards movement to free the end 45 of the support member 40 from the floor and the handle 48 is free to rotate the entire support leg 40 upwards (movement 60) until its longitudinal axis is substantially in line with the longitudinal axis of the extender member 20. At this time the bedspread holder 10 can be easily moved back from its outer use position to its inner storage position. At this time the retaining member 30 is again up against the mattress 110 functioning as a stop with only the actuation handle 48 extending off of the bedspread holder 10 (FIG. 5). This actuation handle 48 can then be again used to grab the bedspread holder 10 to again manipulate it into its outer use position 51. As the actuation handle 48 is substantially directly interconnected to the connection tube 25, which together with the extender member 20 define the planar surface of the bedspread holder 10, movement in to the inner storage position and out to the outer use position is efficient.

Note that the actuation handle 48 is offset from the longitudinal axis of the remainder of the support leg 40 (see FIG. 6). Due to this, in the outer use position of the bedspread holder 10, the actuation handle 48 is substantially aligned with the plane as the retaining member 30 (FIG. 6). The retaining member 30 thus also serves to protect the handle against ill-advertent contact. At the same time, this same attribute allows the handle 48 to be the only exposed part of the holder 10 when such holder is in a storage position (FIG. 5). This allows concealment of the rest of the holder 10 when the holder is not in use. This also provides for a more visually pleasing room.

Although the invention has been described in its preferred embodiment disclosed, it should be understood that changes, alterations, and modifications may be had without deviating from the present invention as hereinafter claimed.

For example, the holder 10 is disclosed with a single support member 40. If desired, multiple support members 40 could be utilized. In such an embodiment, the multiple support members 40 could further be interconnected for common rotation from one, the other, or all by a common connection rod substantially parallel to the main tube (a location would provide for such common rotation is indicated at 70 in FIG. 6). This would provide for spaced in use support of the holder while still allowing easy one-handed operation. This would be appropriate in a wide holder 10 utilizing a wider extender member 20 (i.e., with five rods instead of three). A further example would be to make the holder of plastic, for example with the space between each rod in the embodiment disclosed being solid plastic. Other changes are also possible.

What is claimed is:

1. A bedspread holder for use with a mattress and a bed support part, the mattress and bed support part defining a bed plane therebetween, the bedspread holder comprising a bedspread support member, said bedspread support member defining a member plane and an outer end, said bedspread support member being located between the mattress and bed support part with said member plane co-extensive with the bed plane, said bedspread support member being moveable between an outer use position and an inner storage position with respect to the mattress, said movement of said bedspread support member defining an axis of movement, a support leg, rotary means to connect said support leg to said outer end of said bedspread support member for rotation between a downward support position and an upward storage position, the rotation of said support leg of said rotary means being on a rotary axis substantially perpendicular to said axis of movement of said bedspread support member between the inner storage position and the outer use position, said upward storage position locating said support leg substantially co-extensive with the bed plane and said member plane, and an actuation handle, said actuation handle being connected to said support leg for moving said support leg between the downward support position and the upward storage position.

2. The bedspread holder of claim 1 characterized in that said support leg has a longitudinal axis and said longitudinal axis of said support leg being substantially aligned with said rotary axis of said rotary means.

3. The bedspread holder of claim 2 characterized in that said actuation handle has a longitudinal axis and said longitudinal axis of said actuation handle being parallel to said longitudinal axis of said support leg.

4. The bedspread holder of claim 1 characterized in that said outer end of said bedspread support member is circular and said rotary means includes a circular part about said circular outer end of said bedspread support member.

5. The bedspread holder of claim 1 characterized in that said support leg includes two spaced rods, with said rods interconnected to said rotary means for common rotation.

6. The bedspread holder of claim 5 characterized in that the bedspread support member has a gap therein, said gap being greater than the space between the two spaced rods of said support leg so as to allow storage of said support leg substantially within said gap.

7. The bedspread holder of claim 5 characterized in that said two spaced rods are interconnected at their bottom ends.

8. The bedspread holder of claim 1 characterized by the addition of a retaining rod, said retaining rod being connected to said outer end of said bedspread support member.

9. The bedspread holder of claim 8 characterized in that said retaining rod has an axis and said axis of said retaining rod being substantially coincident with a longitudinal axis of said actuation handle.

10. The bedspread holder of claim 1 characterized in that said bedspread support member includes a multiplicity of substantially U-shaped sub-members.

11. A bedspread holder for use with a mattress and a bed support part, the mattress and bed support part defining a bed plane therebetween, the bedspread holder comprising a bedspread support member, said bedspread support member defining a member plane and an outer end, said bedspread support member being located between the mattress and bed support part with said member plane co-extensive with the bed plane, said bedspread support member being moveable between an outer use position and an inner storage position with respect to the mattress, said movement of said bedspread support member defining an axis of movement, a support leg, rotary means to connect said support leg to said outer end of said bedspread support member for rotation between a downward support position and an upward storage position, the rotation of said support leg of said rotary means being on a rotary axis substantially perpendicular to said axis of movement of said bedspread support member between the inner storage position and the outer use position, said upward storage position locating said support leg substantially co-extensive with the bed plane and said member plane, an actuation handle, said actuation handle being connected to said support leg for moving said support leg between the downward support position and the upward storage position;

said support leg and said actuation handle being on opposite sides of said rotary axis of said rotary means.

12. An apparatus comprising:

a support member extendable between a mattress and a bed support part, the support member being at least partially located between the mattress and the bed support part, the support member being moveable relative to the mattress between an outer use position and an inner storage position along a longitudinal axis extending between an inner end of the support member and an outer end of the support member; and a support leg pivotally connected to the outer end of the support member, the support leg being rotatable relative to the support member between a leg support position and a leg storage position about a rotary axis extending substantially perpendicular to the longitudinal axis, the support leg being extendable between the mattress and the bed support part when in the leg storage position, the support leg supporting the support member in the outer use position when in the leg support position.

13. The apparatus of claim 12, including an actuation handle connected to the support leg for moving the support leg between the leg support position and the leg storage position, the actuation handle and the support leg being on opposite sides of the rotary axis.

14. The apparatus of claim 12, including an actuation handle connected to the support leg for moving the support leg between the leg support position and the leg storage position, the actuation handle extending in a longitudinal direction when the support leg is in the leg storage position.

15. The apparatus of claim 12, including a retaining member extending from the support member transversely with respect to a plane defined by the support member.

16. The apparatus of claim 15, wherein the retaining member extends a first distance from the support member, the actuation handle extending from the support member a second distance smaller than the first distance.

17. The apparatus of claim 15, wherein the retaining member extends from the support member in a first direction and the actuation handle extends from the support member in the first direction.

18. The apparatus of claim 15, wherein the retaining member is adjacent a bedding item supported by the support member when the support member is in the outer use position.

* * * * *